US008602042B2

(12) United States Patent
Grüll et al.

(10) Patent No.: US 8,602,042 B2
(45) Date of Patent: Dec. 10, 2013

(54) DISHWASHER AND APPROPRIATE CONTROL METHOD

(75) Inventors: Franz Grüll, Königsbronn (DE); Anton Oblinger, Gersthofen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 366 days.

(21) Appl. No.: 12/870,930

(22) Filed: Aug. 30, 2010

(65) Prior Publication Data

US 2011/0048460 A1 Mar. 3, 2011

(30) Foreign Application Priority Data

Sep. 2, 2009 (DE) ..... 10 2009 029 148

(51) Int. Cl.

| | |
|---|---|
| ***B08B 7/04*** | (2006.01) |
| ***B08B 9/20*** | (2006.01) |
| ***B08B 3/00*** | (2006.01) |
| ***B08B 3/12*** | (2006.01) |
| ***B08B 6/00*** | (2006.01) |

(52) U.S. Cl.

USPC ..... 134/113; 134/18; 134/25.2; 134/56 D; 134/57 D; 134/58 D; 134/186

(58) Field of Classification Search

USPC ..... 134/105, 108, 56 R, 186, 18, 25.2, 56 D, 134/57 D, 58 D, 113; 68/15, 207

See application file for complete search history.

(56) References Cited

U.S. PATENT DOCUMENTS

| | | | | | |
|---|---|---|---|---|---|
| 4,330,081 | A * | 5/1982 | McMillan | 236/12.1 |
| 4,406,401 | A * | 9/1983 | Nettro | 236/12.12 |
| 4,643,350 | A * | 2/1987 | DeSchaaf et al. | 236/12.12 |
| 6,255,952 | B1 * | 7/2001 | Jang | 340/588 |
| 6,327,730 | B1 * | 12/2001 | Corbett | 8/158 |
| 6,845,536 | B1 * | 1/2005 | Vaidhyanathan et al. | 8/158 |
| 7,886,982 | B2 * | 2/2011 | Larson et al. | 236/12.1 |
| 2007/0008159 | A1 * | 1/2007 | Meyer | 340/588 |
| 2007/0017551 | A1 * | 1/2007 | Hartogh | 134/18 |

FOREIGN PATENT DOCUMENTS

| | | | | |
|---|---|---|---|---|
| DE | 197 17 449 | * | 10/1998 | |
| JP | 09135802 A | * | 5/1997 | A47L 15/46 |
| JP | 10-277290 | * | 10/1998 | |
| JP | 2006247109 A | * | 9/2006 | |
| KR | 2004046227 | * | 6/2004 | |
| KR | 2005021833 | * | 3/2005 | |
| KR | 2006027540 | * | 3/2006 | |
| KR | 2009030991 | * | 3/2009 | |

* cited by examiner

*Primary Examiner* — Michael Kornakov
*Assistant Examiner* — Charles W Kling
(74) *Attorney, Agent, or Firm* — James E. Howard; Andre Pallapies

(57) ABSTRACT

A dishwasher having a control device to control the dishwasher and at least one water feed controlled by the control device. The water feed is connected to at least one external water supply to take in water and the control device automatically controls a monitoring sequence in which at least one limit value is monitored for a temperature of the water that is provided by the external water supply.

19 Claims, 3 Drawing Sheets

DISHWASHER AND APPROPRIATE CONTROL METHOD

BACKGROUND OF THE INVENTION

The present invention relates to a dishwasher, especially a household dishwasher, with a control device for controlling the dishwasher and with at least one water feed able to be controlled by the control device for taking in water, which is designed to be connected to at least one external water supply.

In today's dishwashers items to be washed, especially crockery, are usually cleaned with the aid of water. To carry out a washing process, also called a washing cycle, and to be able to automatically take in the required water, at least one water feed is provided which is able to be controlled by a control device of the dishwasher. To be able to carry out the intake of water there is provision in such cases for connecting the water feed to an external water supply. An external water supply of this type can especially involve a water supply installed on the building side.

The disadvantage of known dishwashers is that connecting the water feed device to an unsuitable external water supply or to a faulty external water supply is frequently not noticed, which can result in damage to the dishwasher.

BRIEF SUMMARY OF THE INVENTION

The object of the present invention is to provide a dishwasher in which this type of damage is prevented.

The object is achieved for a dishwasher of the type stated at the start by the control device embodying at least one monitoring sequence for automatic control, in which monitoring of one or more limit values for a temperature of the external water supply connected to the controllable water feed is undertaken.

In the inventive dishwasher the items to be washed, especially crockery to be washed, are loaded into a washing container and cleaned there in a washing process, also referred to as a washing cycle, with the aid of a washing liquor, and then dried. The object in this case is especially to carry out a washing cycle so that a predefined cleaning result and a predefined drying result are achieved as efficiently as possible. What is demanded in such cases is a high overall efficiency which is expediently produced by the cleaning efficiency and the drying efficiency. The cleaning efficiency in such cases especially corresponds to the ratio of the cleaning result achieved by means of the washing cycle and the effort required for this, with the effort able to include a number of dimensions, for example the energy requirement, the water requirement and/or the time requirement. Furthermore the drying efficiency in particular corresponds to the ratio of the drying result achieved by means of a washing cycle and the effort involved for this, with the effort here too able to include a number of dimensions, for example the energy requirement and/or the time requirement.

A washing liquor is to be understood here as a liquid which is intended to be applied to the items to be washed in order to clean set items and/or process them in some other way. Thus the washing liquor can for example be provided for heating up the items to be washed, which is normal during a rinsing step for example. A washing liquor as a rule consists preponderantly of water. In such cases the washing liquor, depending on the operating phase of the dishwasher, can have accumulations of cleaning agents, auxiliary cleaning agents, such as rinsing agents and/or soiling, released from the items to be washed.

In the inventive dishwasher a control device is provided in which one or more wash programs for controlling a washing cycle for cleaning items to be washed is stored. The control device can be embodied as a so-called sequence control system, especially as an electronic sequence control system. Advantageously in such cases a number of wash programs are provided, of which one can be selected and started by the operator. This makes it possible to adapt the sequence of the washing cycle in particular to the amount of the load, to the type of load, to the degree of soiling of the items to be washed and/or to the desired duration of the washing cycle.

At least one wash program for cleaning the items to be washed comprises a washing step in which water is taken in, a washing liquor including the water taken in is formed and washing liquor is sprayed onto the items to be washed located in the washing compartment. Expediently the wash program provides a number of such washing steps. In such cases this sequence can especially involve a pre-wash step, a cleaning step, an intermediate wash step and a rinsing step. However wash programs can also be provided in which one or more of these program steps are omitted. Wash programs are also possible in which one or more of these program steps are run a number of times. Furthermore a typical wash program includes a subsequent drying step for drying the cleaned items.

A prewash step serves in such cases particularly to remove heavier soiling. The purpose of a subsequent cleaning step is to completely remove soiling from the dishes. An intermediate washing step now carried out serves especially for removal of cleaning agent residues adhering to the dishes. In such cases the washing liquor can expediently be supplied with cleaning agents in order to improve the cleaning effect. A subsequent rinsing step is especially provided for avoiding flecks on the items which could arise because dissolved substances in the water, such as salt and/or lime scale for example. To this end the washing liquor can have rinsing agents added to it during the rinsing step. The dishwasher can provide a so-called separate drying with a further object of the rinsing step then being to prepare for the subsequent drying step. In such cases the dishes are heated up by the washing liquor during the rinsing step to a high temperature so that in the subsequent drying step water droplets adhering to the hot dishes evaporate and condense onto the respective inner side of the washing container because of the lower temperature obtaining there.

In order to be able to provide the washing liquor intended for spraying onto the dishes with the respective cleaning and/or cleaning aid agents, such as rinsing agents for example, the dishwasher can have an automatic dosing device.

The water required for carrying out washing cycles is taken in for the inventive dishwasher via a water feed device featuring at least one controllable water feed. To operate the dishwasher the water feed is connected to an external water supply.

In such cases the water feed can include a valve which can be embodied as a magnetic valve. Such a valve is designed so that it has at least one open state and one closed state. By using these types of valve it is possible in a simple manner, depending on the respective wash program, to take in an amount of water needed in each case. It would further also be possible to use throttle valves or other controllable valves which make it possible to control the throughflow of water exactly. In both cases an external device for controlling the intake of water can be dispensed with.

There can also be provision for the valve to be arranged at an upstream end of an inlet hose and to the embodied so that it is able to be attached to a connecting piece of the external water supply. To this end the valve can have a connection thread for example which corresponds to the threads of normal household faucets. Such valves are especially embodied as so-called aquastop valves. A downstream end of the feed hose is connected to the washing compartment for conveying the fluid via a connecting piece fixed to the housing, so that the water taken in is directed into the washing compartment.

The arrangement of the valve at the upstream end of the water feed has the advantage that practically no leakage water can escape from the dishwasher, even in the event of damage, provided the valve is closed. If the valve is embodied so that it closes when it is not activated an escape of leakage water from a switched-off dishwasher is prevented under practically all circumstances. In order to also prevent an escape of leakage water from a dishwasher which is switched on, the feed hose can be embodied as a safety hose with an inner water-conveying pressure hose and an outer sleeve hose, with a leakage water channel for taking away any leakage water which might occur able to be provided between the pressure hose and the sleeve hose. In such cases the control device can be assigned a leakage water sensor for detecting leakage water so that the control device can close the valve should leakage water occur during the operation of the dishwasher.

The water feed of a dishwasher, i.e. especially the valve and the feed hose, are expediently adapted in respect of their construction to technical features of the external water supply to which the water feed will be connected. Factors determining the constructive embodiment of the water feed in such cases are especially the temperature and/or the pressure of the water delivered by the external water supply. If the actual temperature of the water delivered by the external water supply now deviates significantly from the intended temperature, damage can be caused to the dishwasher and especially to the water feed there. With a significant temperature deviation damage can occur in a relatively short time, but over the longer term however there is a risk of damage even with smaller temperature deviations.

Because the control device of the inventive dishwasher is now embodied for automatic control and execution of at least one monitoring sequence for the temperature of the water provided by the external water supply, both short-term and also long-term damage occurring to the dishwasher can be avoided.

To this end, within the framework of the monitoring sequence, at least one limit value for the temperature of the water delivered is monitored. The at least one limit value to be monitored can be stored in the control device, for example in an electronic memory of the control device. The limit value or limit values can be defined in advance so that a deviation of the actual temperature of the supplied water from a target value, which could cause damage to the dishwasher, will be detected. The monitoring of previously defined limit values especially allows temperature deviations to be recognized which result from a malfunction or incorrect operation of the external water supply, which are the result of the water feed having been connected to a water supply which was unsuitable from the start. If the dishwasher has a number of water feeds, one or more limit values can be monitored for each feed.

In accordance with an expedient development of the invention there is provision for the monitoring sequence to provide for a measurement by means of a temperature sensor of the temperature of water taken in via the water feed. A measurement of the temperature within the framework of the monitoring sequence enables it to be ensured that the limit value or the limit values is or are monitored on the basis of the actual temperature of the water provided. The fact that water which has just been taken via the water feed is measured ensures that the temperature of the water which is measured is that temperature to which the dishwasher is subjected. By comparison with solutions in which the measurements of the temperature are carried out outside the dishwasher, i.e. especially in the area of the external water supply, a simplification is also produced since it is possible to dispense with a data connection between the control device of the dishwasher and an external measuring facility.

In accordance with a preferred development of the invention the measurement can especially be provided during a wash program for washing dishes during the first activation of the water feed for taking in water. In this way account is taken of the situation whereby the temperature of the water provided can change between two wash programs. If the measurement is undertaken during the first activation of the water feed as part of a wash program, it is ensured that a non-tolerable temperature deviation of the water can be recognized at an early stage. The first intake of water during a wash program can occur for example within the framework of the pre-wash step or within the framework of a first cleaning step.

In accordance with an expedient development of the invention the temperature sensor is arranged upstream from the at least one water feed. Practically all modern dishwashers feature this type of temperature sensor. This can be used for example to control the heating device of the dishwasher during the execution of a wash program. In this way an additional temperature sensor can be dispensed with, so that the layout of the dishwasher is simplified. Where the dishwasher has a number of water feeds, it is also possible with this type of temperature sensor connected downstream from the water feeds to measure the temperatures of a number of water supplies with just one sensor. This can be done by a first water feed first being opened, then the temperature of the water taken in by this feed being measured, then the first water feed being closed and later a further water feed being opened in order to measure its water temperature.

In accordance with an advantageous development of the invention the respective monitoring sequence can especially comprise a comparison of the temperature of the water with an upper limit value for the temperature of the water. An upper limit value is understood in this case to be a limit value which sets an upper limit of a tolerance range for the temperature of the water. Thus if the temperature of the water lies below an upper limit value then as a rule no measures dependent on the result of the comparison are to be taken. If the temperature of the water lies above an upper limit value on the other hand, a measure linked to a limit value can be carried out. The storage of upper limit values especially prevents damage which can arise from the temperature of the water being too high.

In accordance with an advantageous development of the invention the respective monitoring sequence can include a comparison of the temperature of the water with a lower limit value for the temperature of the water. During the monitoring of such a lower limit value the monitoring sequence then generally provides for a measure if the temperature of the water is lower than the lower limit value. In this way damage caused to the dishwasher from a temperature of the water which is too low can be avoided.

In accordance with an expedient development of the invention at least one of the limit values is a warning limit value which, if exceeded, provides for the output of a warning message via the output means controllable by the control device, especially by acoustic and/or optical output means. This type of warning limit value can be an upper warning limit value which is deemed to have been exceeded if the temperature is greater than the warning limit value. A warning limit value can however also be a lower warning limit value which is then referred to as having been exceeded if the temperature is lower than the warning limit value.

If such a warning limit value is now exceeded, the output of a warning message is expediently initiated by the control device. This makes the user aware of the fact that the temperature of the water provided deviates from the target temperature. The user can then check the operability of the external water supply connected to the water feed. He can likewise check whether the water feed is basically connected to a suitable water supply. As a result of the warning message he can then take appropriate measures. The warning limit value can be defined so that even a small difference in the temperature of the water from the intended water temperature is displayed. In this way damage only occurring over the long-term to the dishwasher can also be prevented. The output means can comprise a buzzer and/or loudspeaker for outputting acoustic warning messages. For output of optical warning messages, lamps, light emitting diodes, alphanumeric displays and/or graphical displays can be provided.

In accordance with an especially preferred development of the invention at least one of the limit values is an abort limit value which, if exceeded, causes an intake of water to be aborted. This can involve at least one upper abort limit value and/or at least one lower abort limit value. Abort limit values can be defined for the respective water feed so that, should the temperature of the water deviate from the target value which gives rise to the danger of damage occurring over the short term, the water feed is closed in order in this way to avoid immediate damage.

In accordance with an expedient development of the invention, if the intake of water is aborted, there is provision for an abort message to be output via output means controllable by the control device, especially via acoustic and/or optical output means. This enables the user to be made aware of the aborting of the water intake and of the resulting premature abortion of the wash program. The abort message in such cases can be output automatically by the control device via those the output means which are also provided for the output of warning messages. However separate output means are also conceivable, which can however be constructed in a similar way to the output means for warning messages.

In accordance with an expedient development of the invention, one of the one or more controllable water feeds is especially a cold water feed which is intended to be connected to an external cold water supply, with expediently the temperature of the water provided to the cold water feed being compared with an upper warning limit value and/or an upper abort limit value for the temperature of the water. Cold water feeds for connection to a normal household water supply are embodied in respect of their construction so that they can maintain the typical temperatures of the water of such a cold water supply over the entire lifetime of a dishwasher without any problems. Thus for example the valve and the feed hose of the cold water feed can be adapted exactly to the temperatures of the water to be expected. If the cold water feed is supplied with water at a higher temperature however the feed those can sustain short-term or long-term damage depending on the respective temperature and can start to leak for example. Likewise the valve designed for cold water can overheat and thereby become inoperable. By monitoring at least one upper limit value such damage to a cold water feed can be avoided.

In accordance with an expedient development of the invention the upper warning limit value for the water provided to the cold water feed has a value of between 25° C. and 35° C. The values given involve values which, when exceeded, lead to the conclusion that either the cold water feed has been connected to a hot water supply or the cold water supply has been accidentally cross connected to a hot water connection. A warning message output if such a warning limit value is exceeded can cause the user to check the connection of the cold water feed or the operability of the cold water supply.

In accordance with a further expedient development of the invention the upper abort limit value for the water provided to the cold water feed has a value of between 30° C. and 40° C. Temperatures lying below these values for the water taken in can be handled at least over the short term by a normal cold water feed. However if they are exceeded, the operation of the dishwasher is aborted in order to prevent immediate damage.

In accordance with an expedient development of the invention one of the one or more controllable water feeds is especially a hot water feed which is intended to be connected to an external hot water supply, with the temperature of the water provided to the hot water feed being compared to an upper warning limit value and/or to an upper abort limit value for the temperature of the water. Although such hot water feeds are designed for a higher temperature than cold water feeds, the valve and/or the feed close of a hot water feed can still be damaged at especially high temperatures, especially above 50° C. Unforeseen high temperatures for a hot water feed can especially occur during incorrect operation or any other malfunction of the connected hot water supply. Such temperatures can however also arise in the event of a malfunction during temperature regulation of a hot water supply. Monitoring an upper warning limit value and/or an upper abort limit value for the temperature of the water fed to the hot water feed can prevent damage from temperatures which are too high in such cases.

In accordance with an expedient development of the invention the upper warning limit value for the water provided to the hot water feed has a value of between 50° C. and 70° C. A hot water feed can usually withstand temperatures lying below these values at least over the short term, with the operator expediently being notified about the unusually high temperatures so that they can prevent the hot water feed being continuously subjected to temperatures which exceed the warning limit value.

In accordance with a further expedient development of the invention the upper abort limit value for the water supplied to the hot water feed has a value of between 60° C. and 80° C. The abort limit value is set precisely so that short-term damage to the hot water feed can be safely prevented.

In accordance with a further expedient development of the invention a comparison is made between the temperature of the water supplied to the hot water feed and a lower warning limit value for the temperature of the water, with the lower warning limit value having a value of between 30° C. and 40° C. In many case long-term damage to the hot water feed by temperatures which are too low can be avoided in this way. For example a hardening or becoming brittle of the feed hose of the hot water feed, which could lead in conjunction with a mechanical load to permanent damage, can be avoided. In addition information can be provided in this way that the hot water feed has been incorrectly connected to a cold water supply or that the hot water supply is not working correctly.

It goes without saying that the inventive dishwasher can include a cold water feed and a hot water feed for which one or more limit values can be monitored in each case. Such a water feed device can also be referred to a bithermal water feed device.

The invention further relates to a method for operating a dishwasher, especially for operating an inventive dishwasher which features a control device for automatic control of the dishwasher and at least one water feed able to be controlled by the control device for taking in water, with the water feed being connected to the at least one external water supply. There is provision with the inventive method for one or more limit values for a temperature of the water provided by the external water supply to be monitored.

The inventive method makes it possible to avoid damage to a dishwasher.

Other embodiments and developments of the invention are reflected in the subclaims.

BRIEF DESCRIPTION OF THE DRAWINGS

The invention and its developments, as well as their advantages, are explained in greater detail below with reference to figures. The respective figures show schematic diagrams as follows.

DETAILED DESCRIPTION OF EXEMPLARY EMBODIMENTS OF THE PRESENT INVENTION

Figure 1:
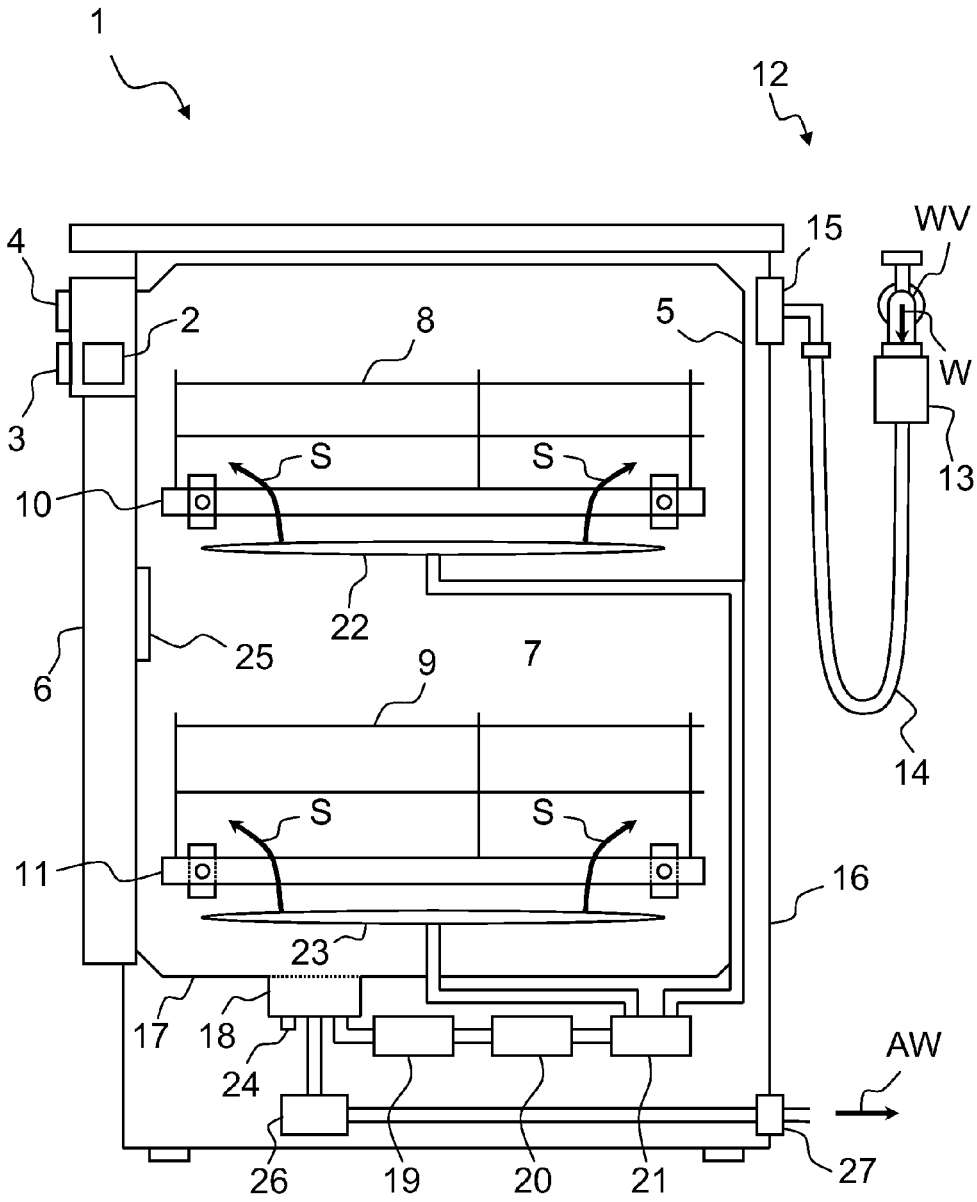
FIG. 1 an advantageous embodiment of an inventive household dishwasher in a schematic view from the side, FIG. 2 a typical flow diagram of a wash program for an inventive dishwasher having a water feed for taking in cold water, and FIG. 3 a typical flow diagram of a wash program for an inventive dishwasher having a water feed for taking in hot water.

In FIG. 1 only those components of a dishwasher which are needed for understanding the invention are provided with reference signs and explained. It goes without saying that the inventive dishwasher can include further parts and modules.

FIG. 1 shows an advantageous exemplary embodiment of an inventive household dishwasher 1 in a schematic view from the side. The dishwasher 1 has a control device 2 in which at least one wash program for controlling a washing cycle of items to be washed, especially crockery, is stored. Expediently a number of wash programs are stored in such devices, so that by selecting a suitable wash program, the sequence of a wash cycle controlled by the control device 2 can typically be adapted to the amount of load, the degree of soiling and/or the desired duration of the wash cycle. The wash program or programs can in this case include at least one cleaning step, at least one intermediate washing step, at least one rinsing step and/or at least one drying step.

The control device 2 is assigned an operating device which allows an operator of the dishwasher 1 to call up and start one of the wash programs. Furthermore the control device 2 is assigned an output device 4 which makes possible the output of messages to the operator. The output device 4 can typically comprise indicator lamps, light emitting diodes, an alphanumeric display and/or a graphical display for output of optical messages. The output device 4 can also feature a buzzer, a loudspeaker and/or the like for output of acoustic messages.

The dishwasher 1 also comprises a washing container 5 able to be closed off by a door 6 so that an enclosed washing compartment is produced for washing dishes. The door 6 is shown in its closed position in FIG. 1. The door is able to be moved into an opened position, in which it is essentially aligned horizontally, by hinging it around an axis arranged at right angles to the plane of the drawing and which allows dishes to be loaded or unloaded. In the exemplary embodiment shown in FIG. 1 the operating device 3 is arranged in an operator-friendly way on an upper section of the door 6. The output device 4 is likewise arranged on an upper section of the door 6, so that optical messages can be easily seen and acoustic messages easily heard. The control device is also positioned there so that the necessary signal connection between the operator device 3, the output device 4 and the control device 2 can be kept short. In principle it is possible however to arrange the operating device 3, the output device 4 and/or the control device 2 at another location. The control device 2 could also be embodied decentrally, which means that it would comprise spatially-separated components which are connected via communication means such that they can interact.

The dishwasher 1 has an upper crockery basket 8 and a lower crockery basket 9 for positioning dishes. The upper crockery basket 8 is arranged in this case on telescopic rails 10 which are attached to a side wall of the washing container 5 in each case. The crockery basket 8 is able to be pulled out from the washing container 5 with the door 6 open by means of the telescopic rails 10. The lower crockery basket is arranged in a similar manner on telescopic rails 11.

The dishwasher 1 also includes a schematically represented water feed 12. In this case the water feed 12 has a valve 13 which is able to be controlled by the control device 2, as well as a feed hose 14.

The valve 13 can typically be embodied as a magnetic valve. The input side of the valve 13 is embodied so that it can be attached to a connecting piece WV of a standard household water supply, for example to a faucet WV. The connection can be made in each case by a screw connection, a snap-on connection or the like. Such a valve 13 can especially be embodied as an aquastop valve. The output side of the valve 13 in this case is connected to the feed hose 14, with its downstream end being connected by a connecting piece 15 to a housing 16 of the dishwasher 1.

In FIG. 1 the input side of the valve 13 is connected to a water faucet WV of an external water supply WV. Consequently it is possible by means of the water feed to take in water from an external water supply WV and direct it into the inside of the dishwasher 1.

Advantageously the valve 13 is closed when it is not activated, so that the dishwasher 1 is disconnected from the water supply WV in the switched-off state. In this way an escape of leakage water from the switched-off dishwasher 1 can be avoided in the event of a fault.

The feed hose 14 can be embodied as a safety hose with an inner water-conducting pressure hose and an outer sleeve hose, with a leakage water channel for removing any leakage water which might possibly have occurred able to be provided between the pressure hose and the sleeve hose. In this case the leakage water channel can be embodied so that leakage water which occurs during operation of the dishwasher 1 in the area of the water feed 12 is conveyed via the connecting piece fixed onto the housing into the inside of the dishwasher 1. Here it can be detected by a leakage water sensor not shown in the drawing so that corresponding measures, such as closing the valve 13, can be initiated.

The dishwasher 1 also features elements not shown in FIG. 1 which make it possible to convey the water W taken in from the outlet of the connecting peace 15 fixed to the housing 15 into the washing compartment 7. In this case there is expediently provision for the water W taken in to be initially routed a via a preparation device not shown in the diagram for preparing the water W taken in before it reaches the washing compartment 7.

Embodied on the floor 17 of the washing container 5 is a collection vessel 18 in which the water W introduced into the washing compartment 7 collects because of gravitational force. The collecting vessel 18 is connected in this case to a circulation pump 19, with the aid of which washing liquor S containing introduced water W can be pumped from the collecting vessel 18 via a heating device 20 to a water switch 21.

The circulation pump 19, the heating device 20 and the water switch 21 are controlled during the operation of the dishwasher 1 by the control device 2.

The heating device is designed for heating up washing liquor S and is embodied as a continuous water heater. As an alternative for in addition a heating element arranged as an open element can be provided, for example a heating element arranged in the washing compartment 7 or in the collection vessel 18.

The water switch 21 makes it possible to pass on the washing liquor S supplied by the circulation pump 19 in a controlled manner. In the exemplary embodiment it has two outputs, of which a first is connected to an upper spray device, especially an upper rotatable spray arm 22, and a second is connected to a lower spray device, especially a lower rotatable spray arm 23. The spray arms 22 and 23 form a spray device 22, 23 arranged in the washing compartment 7 which makes it possible to apply washing liquor S to the dishes. Further outputs can also be provided however, for example to make it possible to feed further spray arms and/or fixed spray elements. The water switch 21 is able to be controlled so that the washing liquor S conveyed by the circulation pump 19 is optionally conveyed through none of the spray arms 22, 23, through one of the spray arms 22, 23 or through both spray arms 22, 23 into the washing compartment 7.

To be able to control the heating device 20 as per requirements a temperature sensor 24 is further provided which is embodied for detecting the temperature of the washing liquor S. The temperature sensor 24 is arranged in the exemplary embodiment in the collection vessel 18. It could have been provided at another point where a thermal contact with the washing liquor S comprising the introduced water W is possible.

The dishwasher 1 can also feature a dosing device 25 which is arranged for example on the inner side of the door 6. The dosing device 25 can be controlled by the control device 2 and makes it possible for the washing liquor S to automatically have cleaning agents and/or cleaning aids, such as rinsing aids for example, added to it during a washing cycle.

Furthermore the dishwasher 1 has a drain pump 26 with the aid of which washing liquor S no longer needed can be pumped out of the collection vessel 18 via a waste water connection 27 to the outside. The waste water connection 27 can be connected by a drain hose to a waste water disposal system not shown in the figure.

In a first exemplary embodiment the dishwasher 1 shown in FIG. 1 can be embodied overall for taking in cold water W. Cold water W in this case is to be understood as water W which is provided by a standard household cold water supply WV and typically has a temperature ranging from 10° C. to 20° C., in exceptional cases ranging from 5° C. to 25° C. In this case the water feed 12 is embodied in respect of its construction so that it can withstand the temperatures over the entire lifetime of the dishwasher 1.

In a second exemplary embodiment the dishwasher 1 shown in FIG. 1 can be designed for taking in hot water W. Hot water W is to be understood in such cases as water W which is heated by a heating device of an external water supply so that it has a target temperature of 50° C. for example. The temperature of the water W provided by an external hot water supply WV can however fluctuate depending on the operating conditions of the external hot water supply WV within a wide range, for example in a range of 40° C. to 60° C. In this case there is typically provision for the water feed 12 to be embodied for the said temperature range of the hot water W.

In a third exemplary embodiment, for an inventive dishwasher 1 not shown in the figure, there can be provision for the intake of both hot water W and also cold water W, which is referred to a bithermal water connection. To this end the dishwasher 1 has two water feeds 12 which can be connected in each case to a connection piece fixed to the housing 15.

With all three exemplary embodiments of the inventive dishwasher 1 there is provision for the operation of the dishwasher 1 for connecting the water feed or feeds to the one or two external water supplies WV respectively. In such cases it is possible however that the temperature of the water W provided by the respective water supply WV does not correspond to that temperature of the water W which is to be taken in by the connected water feed 12. These types of temperature differences can typically arise as a result of a connection to an unsuitable water supply WV, through a malfunction of the water supply WV and/or through incorrect operation of the external water supply WV.

In order to now avoid damage to the dishwasher 1, especially to the water feed 12, the control device 2 is embodied for automatic control of at least one monitoring sequence for the temperature of the water W supplied to the water feed.

Figure 2:
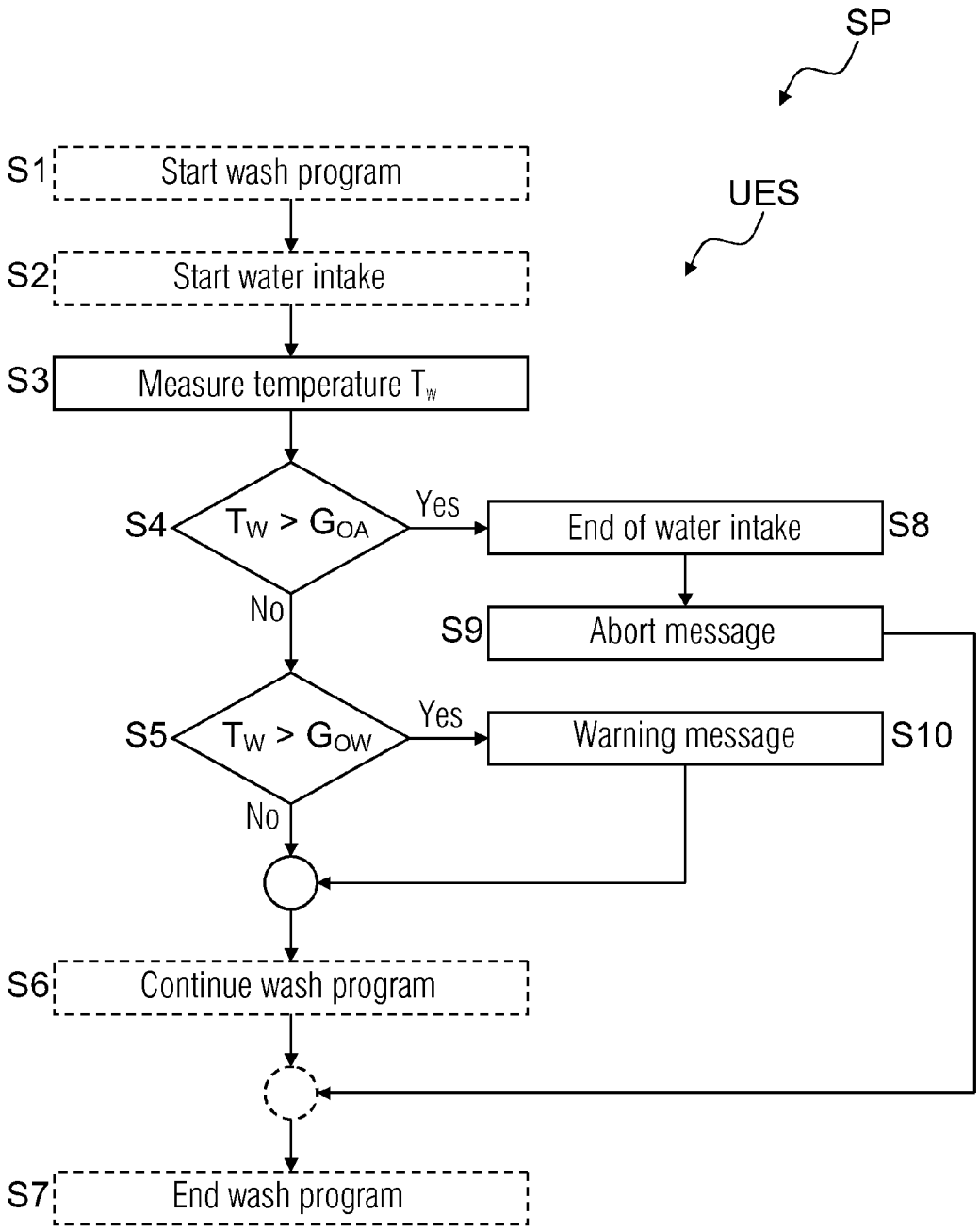

FIG. 2 shows a typical flow diagram of a wash program SP for an inventive dishwasher 1 having a water feed 12 for taking in cold water W. In this case a monitoring sequence UES is embedded into the wash program SP, with the limit values $G_{OA}$, $G_{OW}$ for the temperature $T_W$ of the water W obtained from the external water supply WV are monitored. The wash program SP including the monitoring sequence UES is presented here as a flow diagram, with only those program steps S1-S12 being presented and explained which are necessary for understanding the invention. Naturally further program steps S can be provided. While general program steps S1, S2, S6, S7 are bounded by dashed lines, program steps S2-S5 and S8-S10 of the actual monitoring sequence UES are bounded by solid lines.

The program SP comprises a first program step S1, in which an operator calls up a program, thereby starting it. This operator activity can be undertaken on the operating device 3. The further program steps of the wash program SP are now controlled automatically by the control device 2. In a step S2 which now follows the valve 13 is opened by the control device 2 so that water starts to be taken in for the washing cycle. This means that water W travels from the valve 13 via the feed hose 14, the connecting piece 15 fixed to the housing and via further means not shown in the figure into the washing compartment 7. Here it collects as a result of its gravitational force on the floor 17 of the washing container 5 and from there travels on into the collection vessel 18.

Now the actual supervision sequence UES begins, with the temperature $T_W$ being measured in a step S3 by means of the temperature sensor 24. A measured value of the temperature $T_W$ is then supplied by means not shown in the figure to the control device 2. In a step S4 now controlled by the control device 2 the value of the temperature $T_W$ is compared to an upper abort limit value $G_{OA}$. The upper abort limit value $G_{OA}$ is adapted to the dishwasher 1 so that damage to the latter is excluded provided the upper abort limit value $G_{OA}$ is not exceeded by the temperature $T_W$. The upper abort limit value $G_{OA}$ can for example have a value of between 30° C. and 40° C.

Provided this limit value is not exceeded, the step S5 is executed after the comparison. Here the temperature $T_W$ of the water W is compared with an upper warning value $G_{OW}$.

This is defined so that an unusually high temperature $T_W$ of the water W of the cold water supply WV is recognized. The upper warning limit value can for example have a value of between 25° C. and 35° C. Provided the upper warning limit value $G_{OW}$ is not exceeded, the wash program SP is continued in the conventional manner, which is shown in summary as step S6. Once the wash program is completed, the wash program is ended in step S7.

If however it is established in step S4 that the temperature $T_W$ of the water W exceeds the upper abort limit value $G_{OA}$, in a step S8 the valve 13 is closed and the water intake is thus ended. In this way short-term damage to the dishwasher 1 can be prevented. The ending of the water intake is notified to the operator in a step S9 by outputting an abort message. This immediately displays the fault condition to the operator so that they can take remedial measures without delay. These measures can include a check as to whether the cold water feed 12 may have been accidentally connected to a hot water supply WV, or whether a connected cold water supply WV is operating incorrectly. After the abort message is output the overall wash program SP is then ended.

Provided the upper abort limit value $G_{OA}$ has not been exceeded in step S4, but in step S5 the upper warning limit value $G_{OW}$ has been exceeded, a warning message is output in a step S10. In this way the operator is informed that although the temperature $T_W$ of the water is unusually high, there is no danger of short-term damage. As a result of the warning message the operator can establish the causes of the unusually high temperature $T_W$ of the water and if necessary ensure that these are rectified. Thus even damage occurring to the dishwasher 1 over the long term can be avoided. Since however there is no immediate danger, after the warning message is output, the wash program SP can be continued by moving on to step S6.

Figure 3:
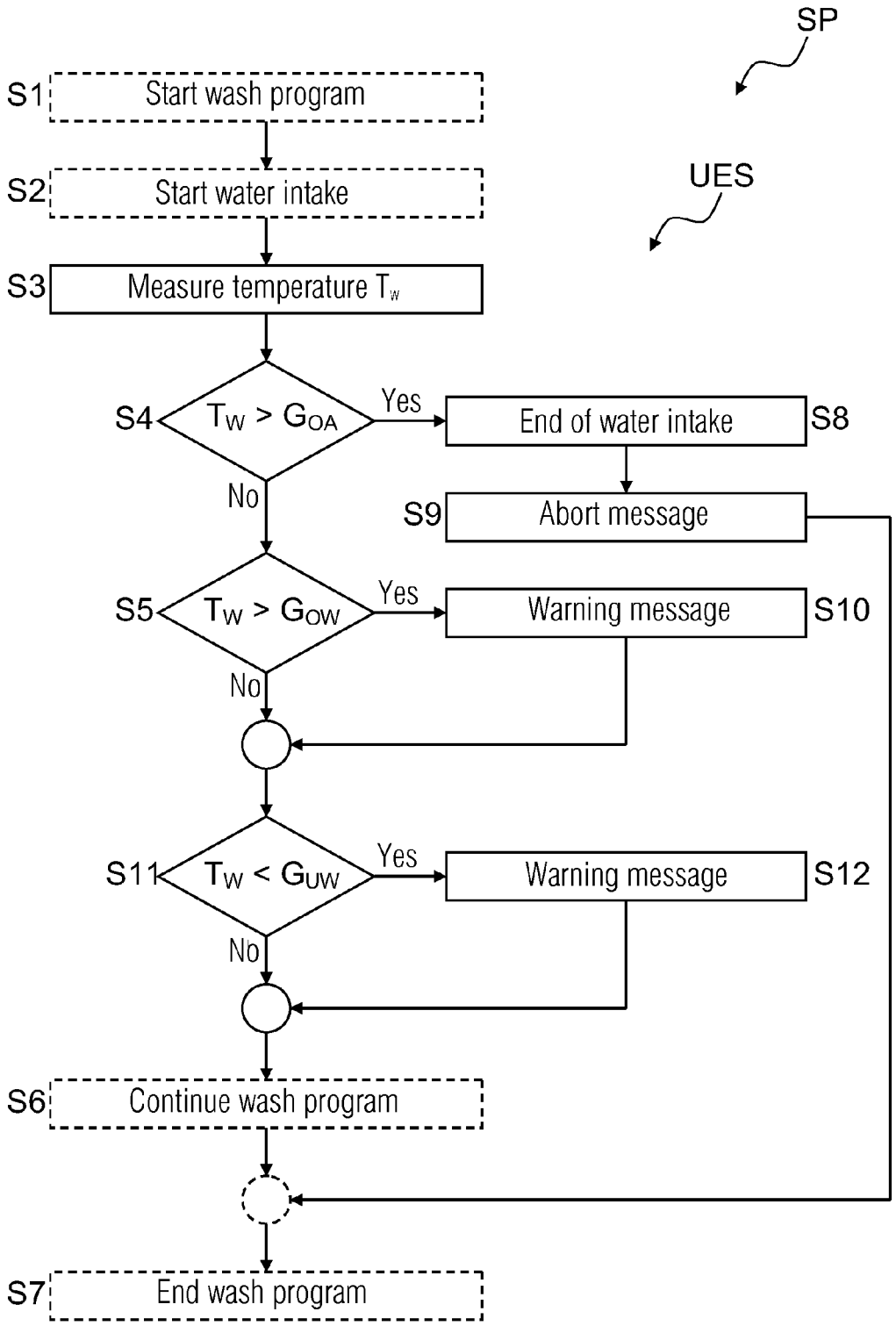

FIG. 3 shows a typical flow diagram of a wash program SP for an inventive dishwasher 1 having a water feed 12 for taking in hot water W. The basic sequence in this case corresponds to the sequence depicted in FIG. 2 for a dishwasher with a cold water feed 12. However the values used in steps S4 and S5 of the upper abort limit value $G_{OA}$ and of the upper warning limit value $G_{OW}$ are higher. Thus the upper abort limit value $G_{OA}$ typically has a value of between 60° C. and 80° C. and the upper warning limit value $G_{OW}$ typically has a value of between 50° C. and 70° C. In addition a step S11 is provided after step S5 in which a lower warning limit value $G_{UW}$ in respect of the temperature $T_W$ of the water W is monitored. Provided the lower limit value $G_{UW}$ is not exceeded, the step S6 is executed after the step S11, so that the wash program SP is continued. If the lower warning limit value $G_{UW}$ is exceeded however a further warning message is then output in step S12.

The lower warning limit value $G_{UW}$ can typically have a value of between 30° C. and 40° C. The warning message output in step S12 can indicate to the operator that the hot water feed 12 may possibly have been accidentally connected to a cold water supply WV or that there is a fault in a connected hot water supply WV.

In one exemplary embodiment the invention relates to a dishwasher 1 having a cold water feed 12 which is designed to be connected to a cold water supply WV. If such a dishwasher 1 is connected to a hot water supply WV, with known dishwashers the operator is not made aware of this fault.

In an inventive dishwasher 1 such an incorrect connection can be shown to an operator, with the water temperature of the first dosed amount entering the device being measured. If for example this amounts to 30° C. and above then it can be assumed that the dishwasher has been connected to a hot water supply WV and the operator can be shown this connection of a device 1 with an intended cold water feed 12 by an optical display or by an error code.

Considered in summary the control device of the dishwasher in an advantageous embodiment variant of the invention especially allows monitoring of whether one or more components of the dishwasher, which are designed or prepared specifically for cold water, are being actually supplied with cold water in a predetermined, permissible temperature range by an external water supply or whether an impermissible temperature overshoot of an upper, permissible temperature limit value of the supplied water is occurring which could lead to overstressing or damage to the one or more elements or components of the dishwasher, such as its water feed hose, water inlet valve etc. for example. By means of the control device a control criterion is derived from the water introduced into the dishwasher and/or flowing into the latter with which a remedy can be initiated in a critical situation occurring in which the temperature is exceeded. Thus for example the inlet valve of the water feed can be blocked by a corresponding control line of the control device.

In this way it can be ensured especially in accordance with an advantageous embodiment variant, that the dishwasher is always only operated in a non-critical temperature range with water from the respective connected water supply.

In particular this also makes possible a device-side detection and notification of whether the dishwasher has been connected to hot water although it is designed and certified for a cold water connection.

If for example a customer or installer connects a dishwasher constructed in accordance with the inventive principle which is designed in accordance with specifications for cold water, to hot water, they can then be made aware of this mistake. Such an incorrect connection can for example the indicated to the customer by the water temperature of the first, dosed inflowing amount of water being measured in the dishwasher and/or at the water inlet. If for example this amounts to 30° C. and above, it can be assumed that the machine has been connected to a hot water supply and this incorrect connection of his dishwasher which is only designed or prepared for a cold water connection can be indicated to the customer, by an optical display or an error code for example. In particular it is also possible in addition or independently of the device-internal temperature measurement, to determine the inlet temperature by means of at least one temperature sensor in the respective inlet line and/or its inlet-side inlet valve.

Conversely it is of course also possible to detect by means of temperature monitoring whether the dishwasher which is prepared or designed for use with hot water is actually also connected to an external hot water supply and is being supplied with hot water. To this end the control device expediently checks whether a lower temperature limit, such as 25° C. for example, is being undershot.

What is claimed is:

1. A dishwasher, comprising:

a control device to control the dishwasher; and a water feed controlled by the control device, the water feed connected to an external water supply to take in water;

wherein the control device is configured to automatically control at least one temperature monitoring sequence wherein a first limit value is monitored by a temperature sensor within the dishwasher for a temperature of the water provided by the external water supply, the first limit value being an abort limit, which, when exceeded, indicates that damage may occur to the dishwasher if operations continue and the control device acts to cease dishwasher operations, followed in sequence by a second limit value less than the first limit value, the second limit value being monitored by the temperature sensor for a temperature of the water provided by the external water supply, the second limit value being a warning limit, which, when exceeded, indicates that damage may occur to the dishwasher if operations continue and the control device acts to issue a warning, the monitoring sequence occurring during filling prior to dishwasher washing operations.

2. The dishwasher of claim 1, wherein the dishwasher is a household dishwasher.

3. The dishwasher of claim 1, wherein the first limit value monitoring and second limit value monitoring are provided during a wash program for washing dishes at a first activation of the water feed.

4. The dishwasher of claim 1, wherein the temperature sensor is arranged downstream from the water feed.

5. The dishwasher of claim 1, wherein the monitoring sequence includes a comparison of the temperature of the water with a lower limit value for the temperature of the water.

6. The dishwasher of claim 1, wherein the second limit value, when exceeded, provides for an output of the warning message via output means that is controlled via the control device.

7. The dishwasher of claim 6, wherein the output means is at least one of an acoustic output means and an optical output means.

8. The dishwasher of claim 1, wherein the first limit value, when exceeded, provides for aborting water intake.

9. The dishwasher of claim 8, wherein, if the water intake is aborted, an abort message is output via output means that are controlled by the control device.

10. The dishwasher of claim 9, wherein the output means is at least one of an acoustic output means and an optical output means.

11. The dishwasher of claim 1, wherein the water feed is a cold water feed that is connected to an external cold water supply, wherein the temperature of the water provided to the cold water feed is compared to at least one of an upper warning limit value and an upper abort limit value for the temperature of the water.

12. The dishwasher of claim 11, wherein the upper warning limit value for the water provided for the cold water feed is between 25° C. and 35° C.

13. The dishwasher of claim 11, wherein the upper abort limit value for the water provided for the cold water feed is between 30° C. and 40° C.

14. The dishwasher of claim 1, wherein the water feed is a hot water feed that is connected to an external hot water supply, and wherein the temperature of the water provided to the hot water feed is compared to at least one of an upper warning limit value and an upper abort limit value for the temperature of the water.

15. The dishwasher of claim 14, wherein the upper warning limit value for the water provided for the hot water feed is between 50° C. and 70° C.

16. The dishwasher of claim 14, wherein the upper abort limit value for the water provided for the hot water feed is between 60° C. and 80° C.

17. The dishwasher of claim 16, wherein the temperature of the water provided to the hot water feed is compared with a lower warning limit value for the temperature of the water.

18. The dishwasher of claim 17, wherein the lower warning limit value is between 30° C. and 40° C.

19. A method for operating a dishwasher, having a control device for automatic control of the dishwasher and at least one water feed for taking in water, the at least one water feed controlled by the control device and connected to an external water supply, the method comprising:

monitoring, by the control device using a temperature sensor in the dishwasher, a first limit value for a temperature of the water that is provided by the external water supply, the first limit value being an abort limit, which, when exceeded, indicates that damage may occur to the dishwasher if operations continue and the control device acts to cease dishwasher operations, followed in sequence by monitoring, by the control device using a temperature sensor in the dishwasher, a second limit value, the second limit value being less than the first limit value, for a temperature of the water that is provided by the external water supply, the second limit value being a warning limit, which, when exceeded, indicates that damage may occur to the dishwasher if operations continue and the control device acts to issue a warning, the monitoring sequence occurring during filling prior to dishwasher washing operations.

* * * * *